US009300090B2

(12) United States Patent
Xu et al.

(10) Patent No.: US 9,300,090 B2
(45) Date of Patent: Mar. 29, 2016

(54) RECEPTACLE CONNECTOR

(71) Applicant: ADVANCED-CONNECTEK INC., Taipei (TW)

(72) Inventors: Fu-Yi Xu, Taipei (TW); Wei Wan, Taipei (TW); Shu-Lin Duan, Taipei (TW); Ching-Tien Chen, Taipei (TW)

(73) Assignee: ADVANCED-CONNECTEK INC., Taipei (TW)

( * ) Notice: Subject to any disclaimer, the term of this patent is extended or adjusted under 35 U.S.C. 154(b) by 35 days.

(21) Appl. No.: 14/025,106

(22) Filed: Sep. 12, 2013

(65) Prior Publication Data

US 2014/0073169 A1 Mar. 13, 2014

(30) Foreign Application Priority Data

Sep. 12, 2012 (CN) ..... 2012 1 0335987

(51) Int. Cl.

| | |
|---|---|
| ***H01R 13/648*** | (2006.01) |
| ***H01R 13/6461*** | (2011.01) |
| ***H01R 13/11*** | (2006.01) |
| ***H01R 13/187*** | (2006.01) |

(52) U.S. Cl.

CPC ..... *H01R 13/6461* (2013.01); *H01R 13/11* (2013.01); *H01R 13/187* (2013.01)

(58) Field of Classification Search

CPC ..... H01R 23/6823
USPC ..... 439/353, 607.4, 607.35, 357
See application file for complete search history.

(56) References Cited

U.S. PATENT DOCUMENTS

| | | | | |
|---|---|---|---|---|
| 7,614,920 | B1 * | 11/2009 | Yi | 439/682 |
| 8,535,097 | B2 * | 9/2013 | Yen et al. | 439/607.27 |
| 9,028,269 | B2 * | 5/2015 | Hsu et al. | 439/357 |

* cited by examiner

*Primary Examiner* — Phuong Dinh
(74) *Attorney, Agent, or Firm* — Rabin & Berdo, P.C.

(57) ABSTRACT

A receptacle connector, for being inserted by a plug connector and contacted with a casing of the plug connector, includes a housing, a plurality of elastic pieces and a plurality of auxiliary fastening members. The housing includes a plurality of first surfaces and a plurality of second surfaces. The second surfaces are connected to two ends of the first surfaces so as to form an inserting window. The elastic pieces are disposed on the first surfaces. The auxiliary fastening members are disposed on the first surfaces. Each auxiliary fastening member includes a contacting portion formed extendedly at an inner side of the inserting window. When the contacting portions connected with the casing, the contact area between the casing and the auxiliary fastening members can be increased by the contacting portions so as to reduce the contact impedance or resistance between the plug connector and the receptacle connector.

16 Claims, 10 Drawing Sheets

RECEPTACLE CONNECTOR

CROSS-REFERENCES TO RELATED APPLICATIONS

This non-provisional application claims priority under 35 U.S.C. §119(a) on Patent Application No. 201210335987.3 filed in China, P.R.C. on Sep. 12, 2012, the entire contents of which are hereby incorporated by reference.

BACKGROUND

1. Technical Field

The disclosure relates to a receptacle connector, and particularly relates to a receptacle connector in which the contact impedance or electrical resistance between a metal shell of a plug connector and a metal shell of the receptacle connector is reduced when the plug connector is inserted into the receptacle connector and the metal shell of the plug connector is in contact with the metal shell of the receptacle connector.

2. Related Art

Using an electric apparatus, such as a notebook, is a very common daily experience. Along with the tendency of thinning and lightening, the occupied volume of the receptacle connector on the electric apparatus should also be reduced; however, upon reducing the volume of the receptacle connector, the signal interference issue caused by the electromagnetic interference of the receptacle connector should also be considered.

Additionally, in order to increase the transmitting speed significantly, the number of the conducting terminals of the receptacle connector has to be increased and the conducting terminals have to be arranged densely, so that the signal interferences, such as electrostatic interference, electromagnetic interference, impedance matching, noise interference, crosstalk between adjacent conducting terminals and so forth, are raised quite easily upon transmitting high frequency signals when the distance between two adjacent conducting terminals is too closer or when the terminals are bent or twisted.

A conventional receptacle connector has fool-proofing elastic pieces. When a plug connector is inserted to the conventional receptacle connector, the elastic pieces are contacted with the metal shell of the conventional receptacle connector for grounding. However, the contact area between the metal shell of the plug connector and the metal shell of the receptacle connector is not large enough to reduce the contact impedance or electrical resistance between the metal shell of the plug connector and the metal shell of the conventional receptacle connector when the plug connector is inserted into the receptacle connector and the metal shell of the plug connector is in contact with the metal shell of the receptacle connector and to reduce the electromagnetic interference of the conventional receptacle connector.

Therefore, improving the design of the metal shell of the conventional receptacle connector to reduce the contact impedance or electrical resistance between the metal shell of the plug connector and the metal shell of the conventional receptacle connector when the plug connector is inserted into the receptacle connector and the metal shell of the plug connector is in contact with the metal shell of the receptacle connector and to reduce the electromagnetic interference of the conventional receptacle connector, is an important issue.

SUMMARY

In view of this, the disclosure proposes a receptacle connector so as to reduce the contact impedance or electrical resistance between a metal shell of a plug connector and a metal shell of the receptacle connector when the plug connector is inserted into the receptacle connector and the metal shell of the plug connector is in contact with the metal shell of the receptacle connector and to reduce the electromagnetic interference.

One invention concept of the disclosure proposes a receptacle connector, which is provided for being inserted by a plug connector and contacted with a metal shell of the plug connector and includes a metal shell, a plurality of elastic pieces and a plurality of auxiliary fastening members. The metal shell includes a plurality of first surfaces and a plurality of second surfaces. The second surfaces are connected to two ends of the first surfaces so as to form an inserting window. The elastic pieces are disposed on the first surfaces. The auxiliary fastening members are disposed on the first surfaces. A first interval is defined between one of the auxiliary fastening members and the near second surface. A second interval is defined between one of the auxiliary fastening members and the near elastic piece. Each auxiliary fastening member includes a contacting portion formed extendedly at an inner space of the metal shell of the receptacle connector. When the contacting portions connected with the metal shell of the plug connector, the contact area between the metal shell of the plug connector and the auxiliary fastening members can be increased by the contacting portions so as to reduce the contact impedance or electrical resistance between the metal shell of the plug connector and the metal shell of the receptacle connector.

According to the disclosure, the auxiliary fastening members are disposed on the four corners of the first surfaces and near the inserting window of the metal shell, and the contacting portions of auxiliary fastening members are applied to contact with the surface of the metal shell of the plug connector so as to increase the contact area, reduce the contact impedance or electrical resistance and further decrease the electromagnetic interference of the receptacle connector. In addition, the auxiliary fastening members are provided for guiding the inserting orientation of the plug connector so as to prevent the elastic pieces of the receptacle connector from being damaged when the plug connector is abnormally inserted into the receptacle connector, so that the sustainability and the stability of the receptacle connector upon inserting into/pulling out the plug connector are guaranteed.

The detailed features and advantages of the disclosure are described below in great detail through the following embodiments; the content of the detailed description is sufficient for those skilled in the art to understand the technical content of the disclosure and to implement the disclosure there accordingly. Based upon the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
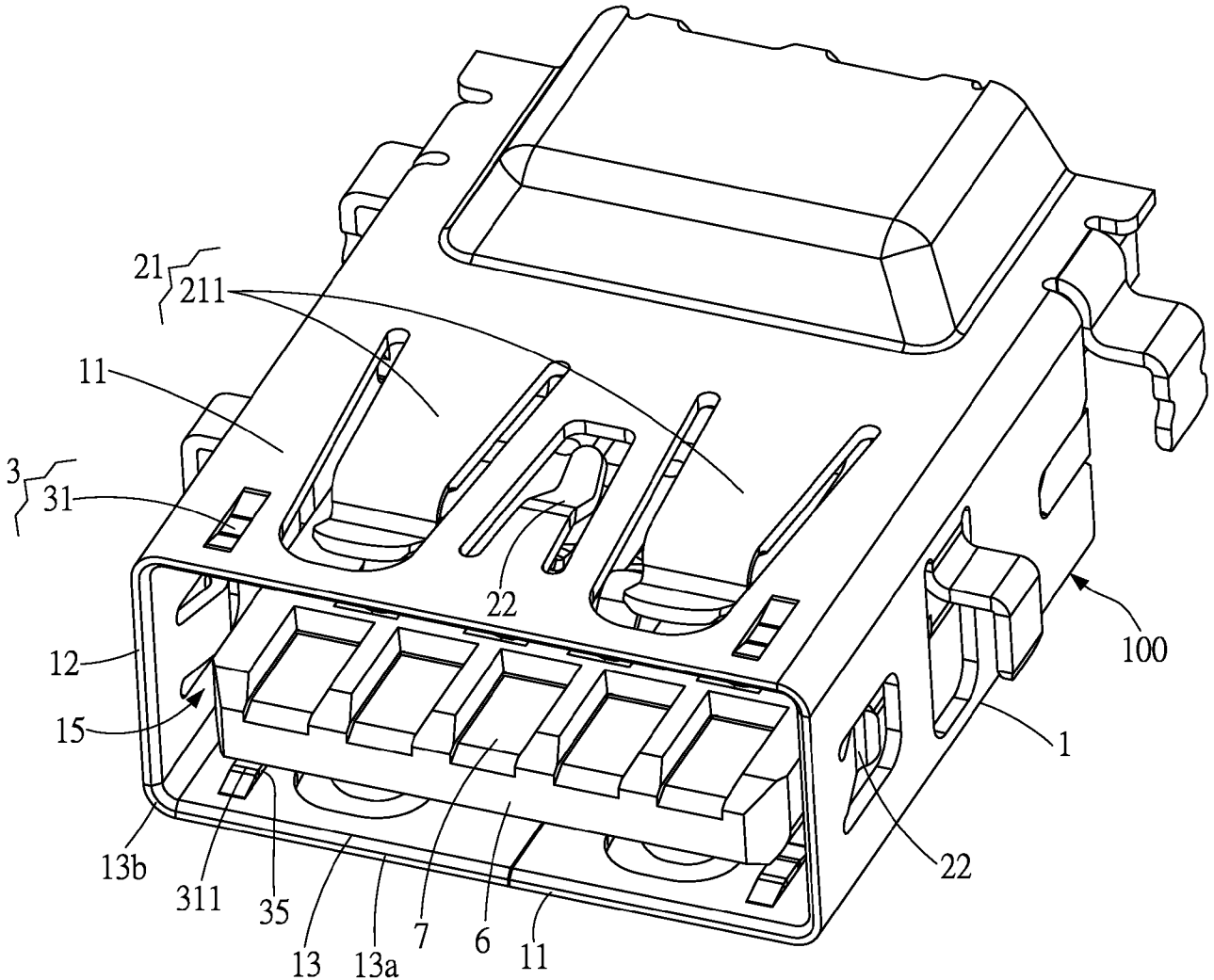
FIG. 1 is a perspective view of a receptacle connector formed in a first exemplary embodiment according to the present invention.
Figure 2:
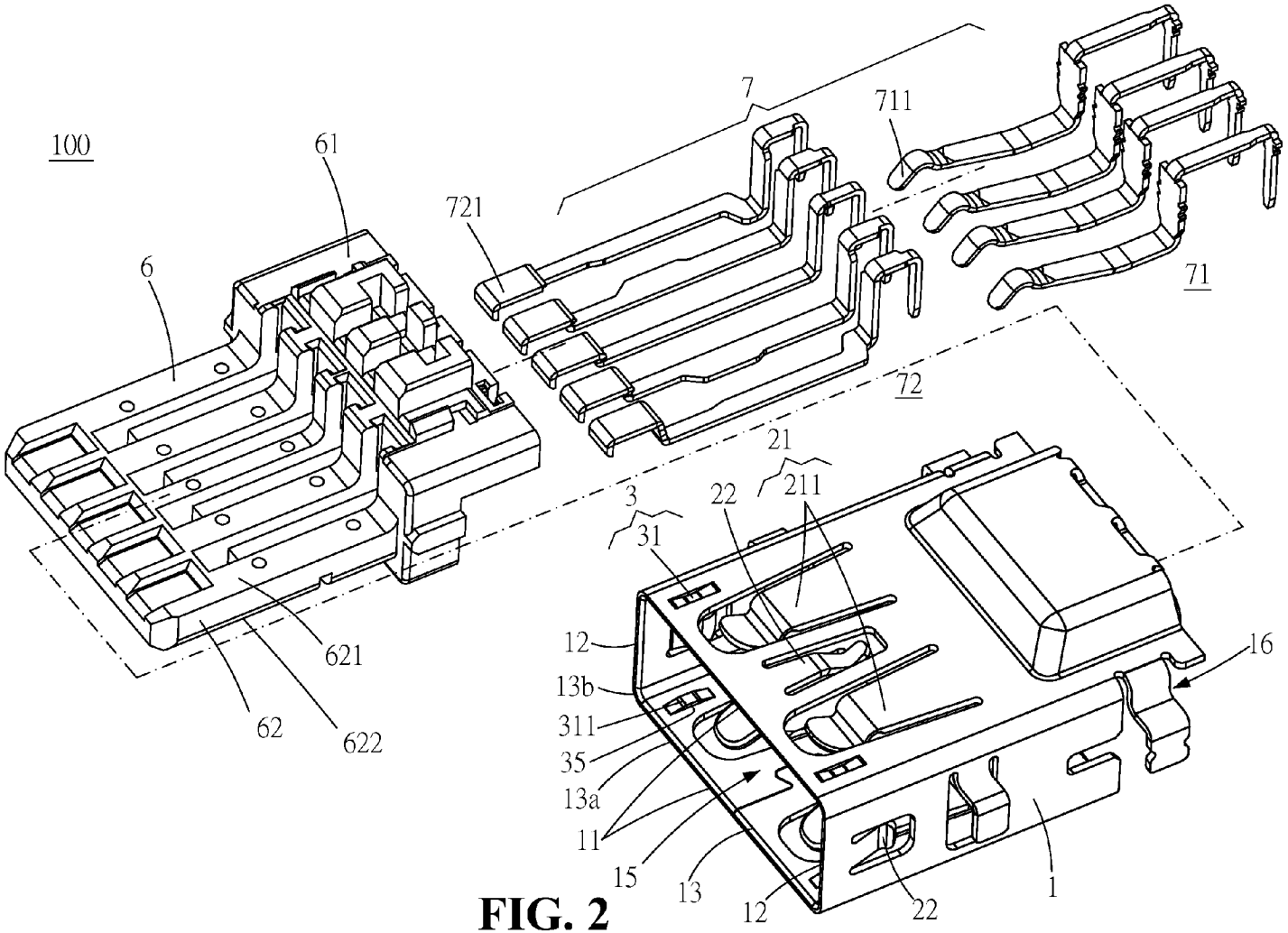
FIG. 2 is an exploded view of the receptacle connector formed in a first exemplary embodiment according to the present invention.
Figure 10:
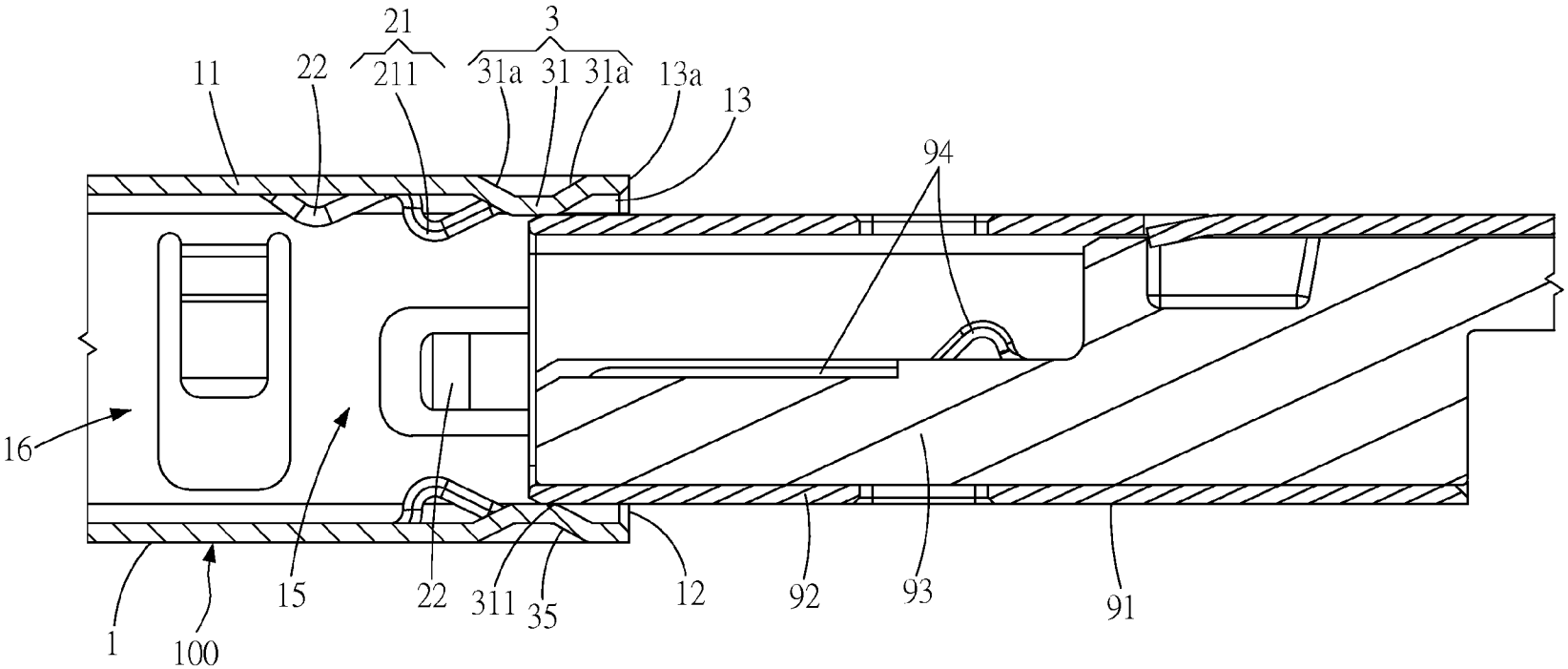
FIG. 10 is another lateral cross-sectional view showing the plug connector being inserted into the receptacle connector during insertion.

FIG. 1 and FIG. 2 are respectively a perspective view and an exploded view of a receptacle connector 100 formed in a first exemplary embodiment according to the present invention. In this embodiment, the receptacle connector 100 is applied for the USB 3.0 interface, but embodiments of the disclosure are not limited thereto; in some implementation aspects, the receptacle connector 100 can be applied for the USB 2.0 interface, the HDMI interface, the Display port interface or the RJ-45 interface. When a plug connector 91 is inserted into the receptacle connector 100, a metal shell 1 of the receptacle connector 100 contacts with a metal shell 92 of the plug connector 91, as shown in FIG. 10.

Referring to FIGS. 1-2, the receptacle connector 100 includes a metal shell 1, a plurality of elastic pieces 21, a plurality of auxiliary fastening members 3, an insulated housing 6 and a plurality of terminals 7. The insulated housing 6 is made of plastic and is enclosed by the metal shell 1. The insulated housing 6 includes a base portion 61 and a tongue portion 62 protruding beyond the base portion 61. The tongue portion 62 is extended along a rear-to-front direction and includes a mating face 621 and an opposite face 622 thereof. A plurality of terminals 7 are held in the insulated housing 6. The plurality of terminals 7 are divided into a first set 71 of terminals 7 which have a first differential pair of signal terminals and a first and a second non-signal terminals disposed at two opposite sides of the first differential pair of signal terminals and a second set 72 of terminals 7 which have a second and a third differential pair of signal terminals therebetween. A plurality of elastic contact portions 711 of the first set 71 of terminals 7 are located on the mating face 621 in a first position along the rear-to-front direction. A plurality of non-elastic contact portions 721 of second set 72 of terminals 7 are located on the mating face 621 in a second position along the rear-to-front direction which are different from the first position. The terminals 7 of the receptacle connector 100 are in contact with a plurality of terminals 94 (shown in FIGS. 9-10) of the plug connector 91 when the plug connector 91 is inserted into the receptacle connector 100.

Figure 3:
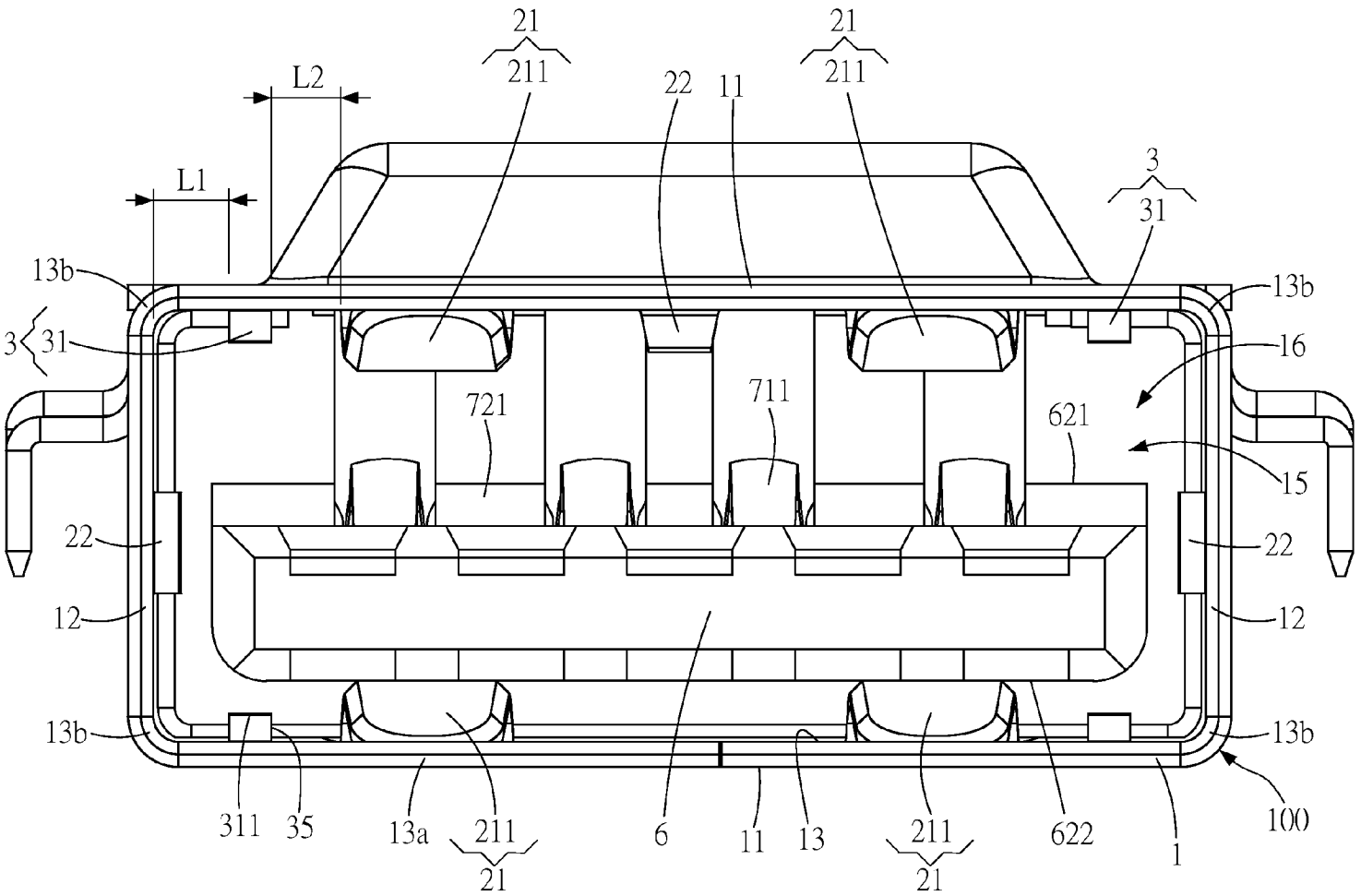
FIG. 3 is a front view of the receptacle connector formed in a first exemplary embodiment according to the present invention.
Figure 4:
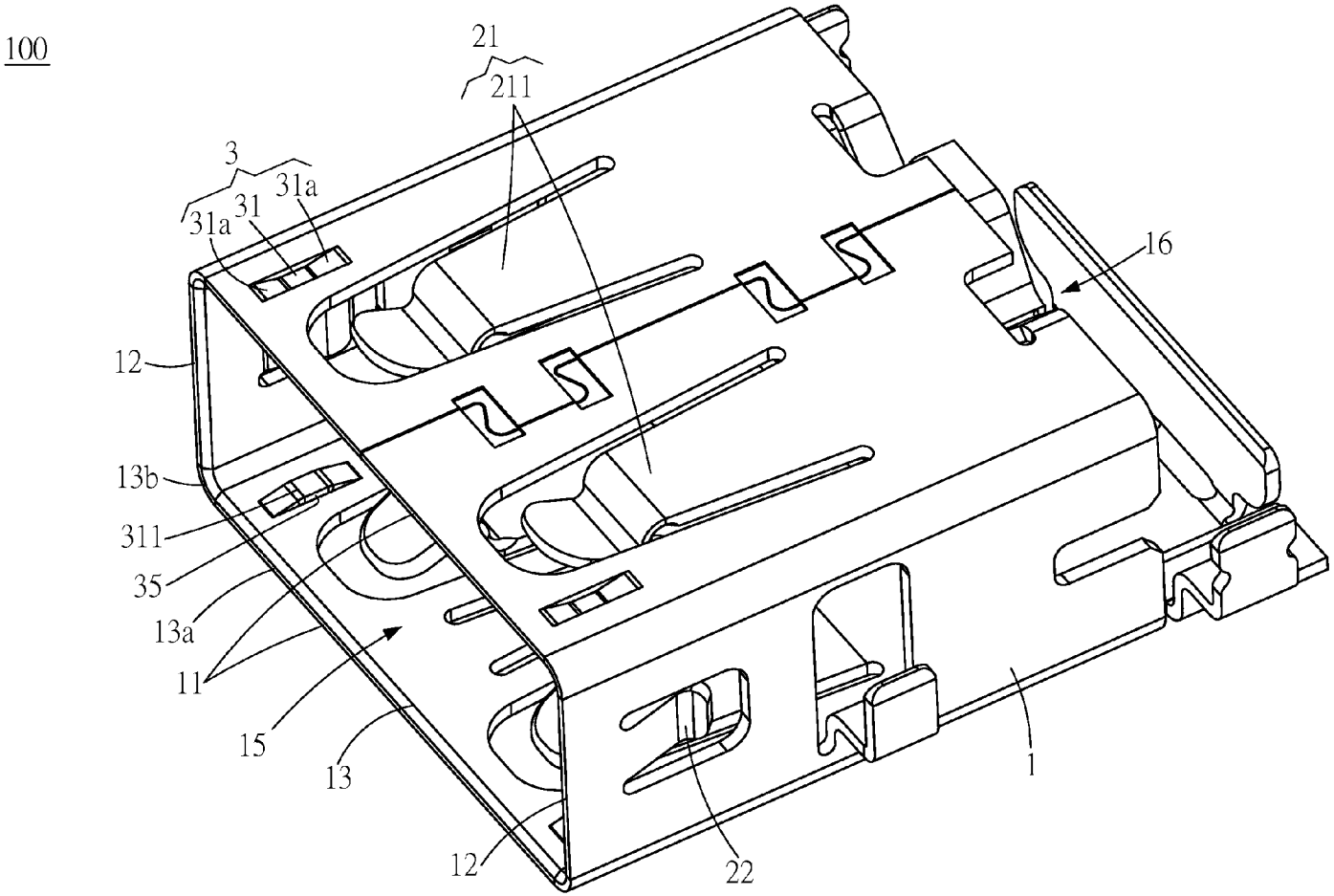
FIG. 4 is a bottom-right side view of a metal shell of the receptacle connector formed in a first exemplary embodiment according to the present invention.

Referring to FIGS. 3-4, the metal shell 1 is a hollowed body and defines a cavity for receiving the insulated housing 6. The cavity defines a connecting space 15 and a receiving space 16 which are formed inside the metal shell 1 and the connecting space 15 communicates with the receiving space 16. The connecting space 15 is utilized for receiving the plug connector 91 during insertion and the insulated housing 6 occupies the receiving space 16.

Referring to FIGS. 3-4, the metal shell 1 includes a plurality of first surfaces 11 (namely, the upper surface and the bottom surface), and a plurality of second surfaces 12 (namely, the left surface and the right surface). The second surfaces 12 connected to the two ends of the first surfaces 11. Here, the first surfaces 11 and the second surfaces 12 are combined with each other so as to form the inserting window 13. The size of the inserting window 13 is larger than the size of the plug connector 91, so that the plug connector 91 is capable of being inserted into the inserting window 13, as shown in FIG. 10.

Referring to FIGS. 2-4, the elastic pieces 21 are disposed on the first surfaces 11. Here, the elastic pieces 21 are disposed on the two sides of the center regions of the first surfaces 11. Each elastic piece 21 substantially has an elastic arm 211. One end of each elastic arm 211 is connected to one of the first surfaces 11, and the other end of each elastic arm 211 is a free end and extended to the inner side of the inserting window 13 so as to swing elastically and contact with the metal shell 92 of the plug connector 91. Here, the elastic pieces 21 further have a plurality of auxiliary elastic pieces 22 disposed on the first surfaces 11 and the second surfaces 12.

Referring to FIGS. 2-4, the auxiliary fastening members 3 are disposed on the first surfaces 11. That is to say, the auxiliary fastening members 3 are disposed on the two sides of the first surfaces 11. The auxiliary fastening members 3 can be formed on the four corners of the metal shell 1, which are adjacent to the inserting window 13 and the near second surfaces 12.

Figure 5:
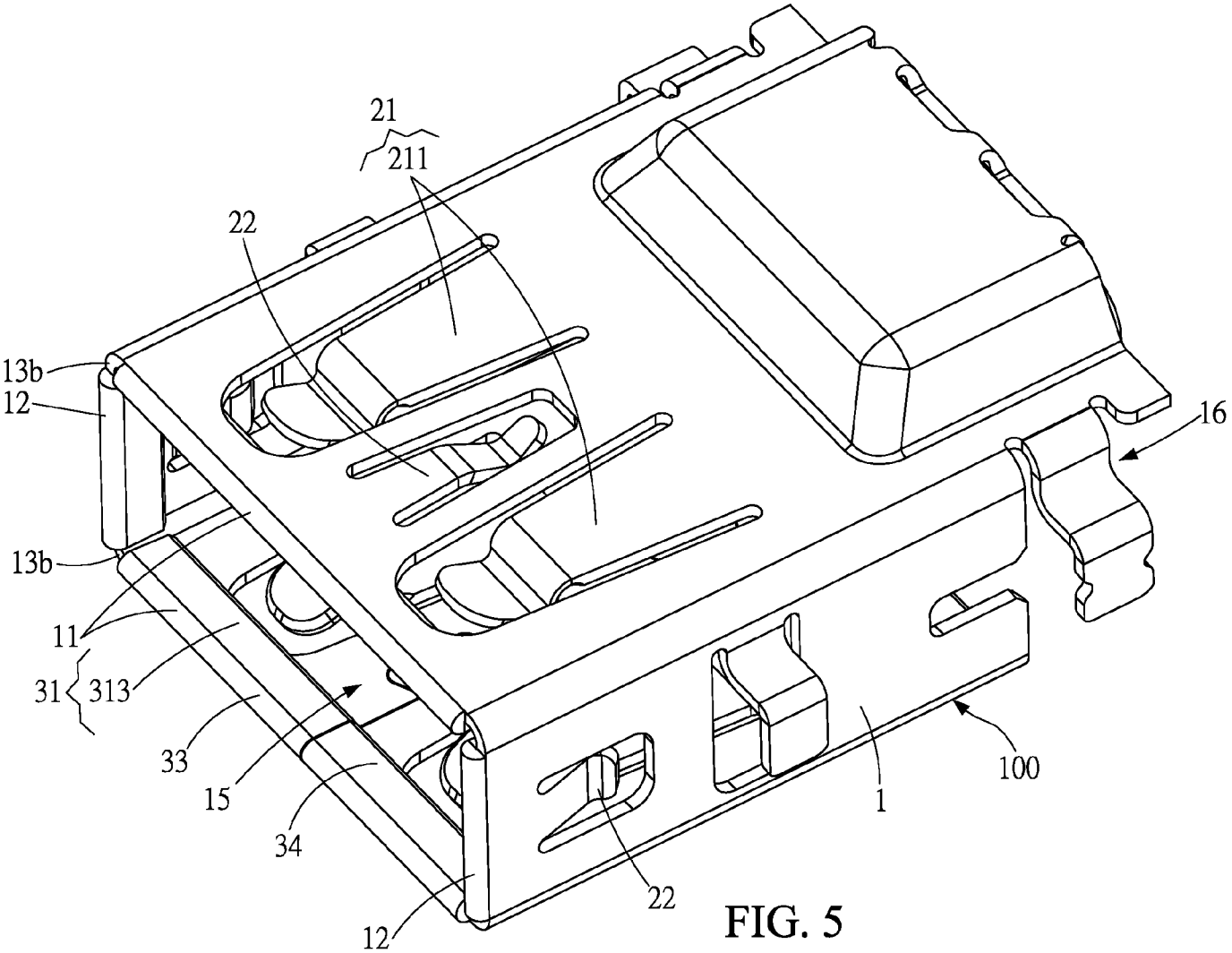
FIG. 5 is a perspective view of an auxiliary fastening member of the receptacle connector formed in a second exemplary embodiment according to the present invention.
Figure 6:
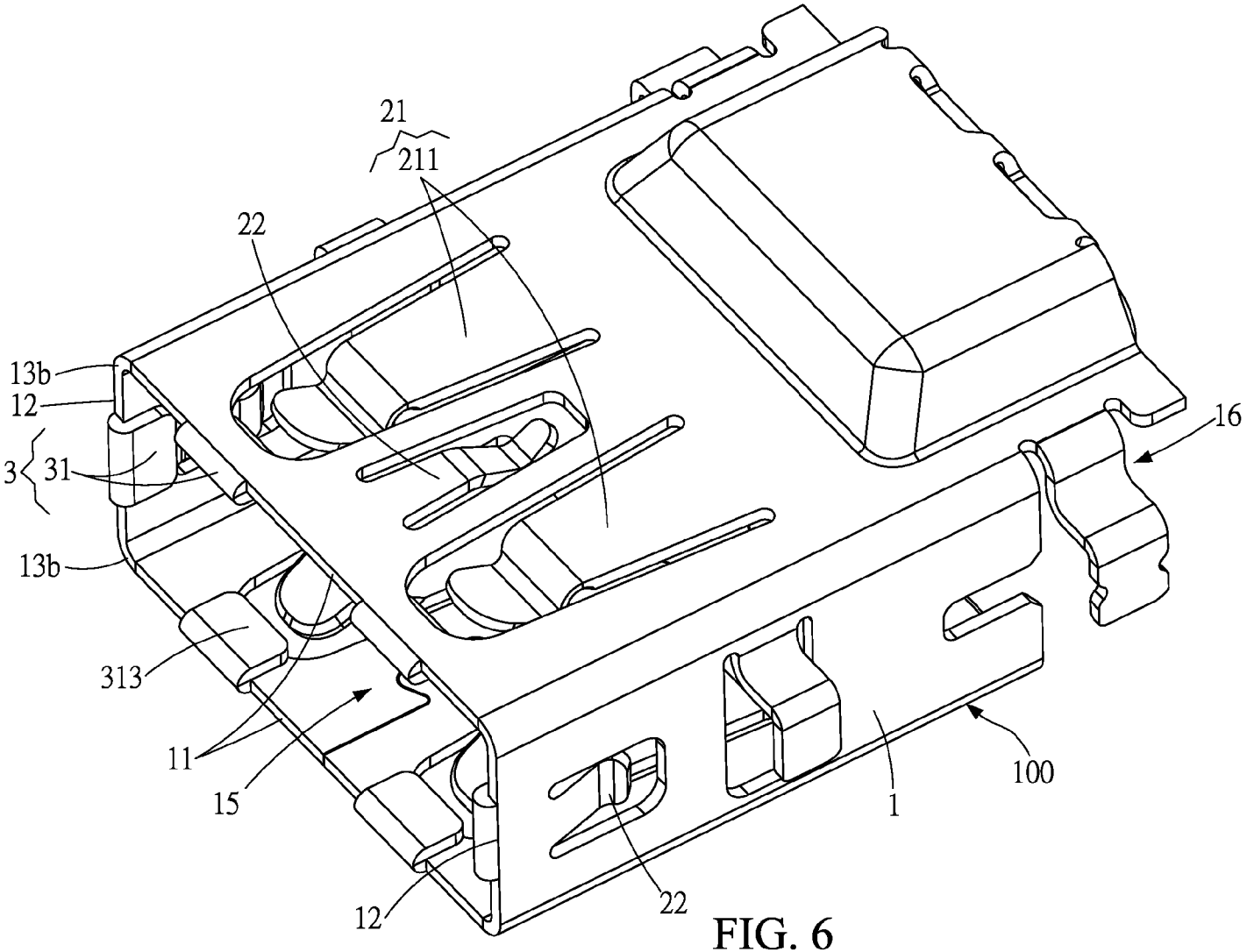
FIG. 6 is a perspective view of the auxiliary fastening member of the receptacle connector formed in a third exemplary embodiment according to the present invention.

In the embodiment mentioned above, the auxiliary fastening members 3 are disposed on the first surface 11, but embodiments of the disclosure are not limited thereto. In some implementation aspects, the auxiliary fastening members 3 are disposed on the second surfaces 12, as shown in FIGS. 5-6.

Referring to FIG. 3, a first interval L1 is defined between one of the auxiliary fastening members 3 and the near second surface 12. The first interval L1 is equal to or larger than 1 millimeter. A second interval L2 is defined between the auxiliary fastening member 3 and the near elastic piece 21. The second interval L2 is equal to or larger than 1 millimeter. Any one of the auxiliary fastening members 3 is disposed between the near elastic piece and the near second surface 12.

Referring to FIG. 4, each auxiliary fastening member 3 includes a contacting portion 31. The contacting portions 31 are formed extendedly at the inner side of the inserting window 13. That is to say, the contacting portions 31 are formed by extruding the inner faces of the first surfaces 11 toward the connecting space 15 which is an inner space of the metal shell 1 of the receptacle connector. The contacting portions 31 can be generated by stamping the first surfaces 11 of the metal shell 1 and extruding the inner faces of the first surfaces 11 toward the connecting space 15. For the embodiments shown in FIGS. 2-4, two ends 31*a* of the contacting portion 31 are connected to the first surfaces 11.

In the embodiment mentioned above, the contacting portions 31 are formed by extruding the inner faces of the first surfaces 11 toward the inner space of the metal shell 1, but embodiments of the disclosure are not limited thereto. In some implementation aspects, each contacting portion 31 includes a bending segment 33 and an extending segment 34, as shown in FIG. 5. The bending segments 33 are disposed on the flanges 13*a* of the inserting window 13 (in FIG. 5, the flanges 13*a* are covered by the bending segments 33). The extending segments 34 are extended from the bending segments 33 and toward the inner space of the metal shell 1; namely, the bending segments 33 and the extending segments 34 are bent to the inner space of the metal shell 1 from the flanges 13*a* of the inserting window 13.

Additionally, referring to FIG. 5, one bending segment 33 and one extending segment 34 are formed at each flange 13*a* of the inserting window 13, but not formed at the turning corners 13*b* of the inserting window 13; however, in some implementation aspects, bending segments 33 and extending segments 34 are formed at each flange 13*a* of the inserting window 13. That is to say, a distance is defined between each two adjacent bending segments 33 (or each two adjacent extending segments 34), at each flange 13*a*. Here, the bending segments 33 and the extending segments 34 are disposed around the flanges 13*a* of the inserting window 13. In other words, the bending segments 33 and the extending segments 34 are formed at the two sides of the first surfaces 11, as shown in FIG. 6.

Referring to FIGS. 2-4, two elongating openings 35 are formed between the contacting portion 31 of each auxiliary fastening member 3 and the first surface 11. The elongating openings 35 are manufactured by a tearing process.

Figure 7:
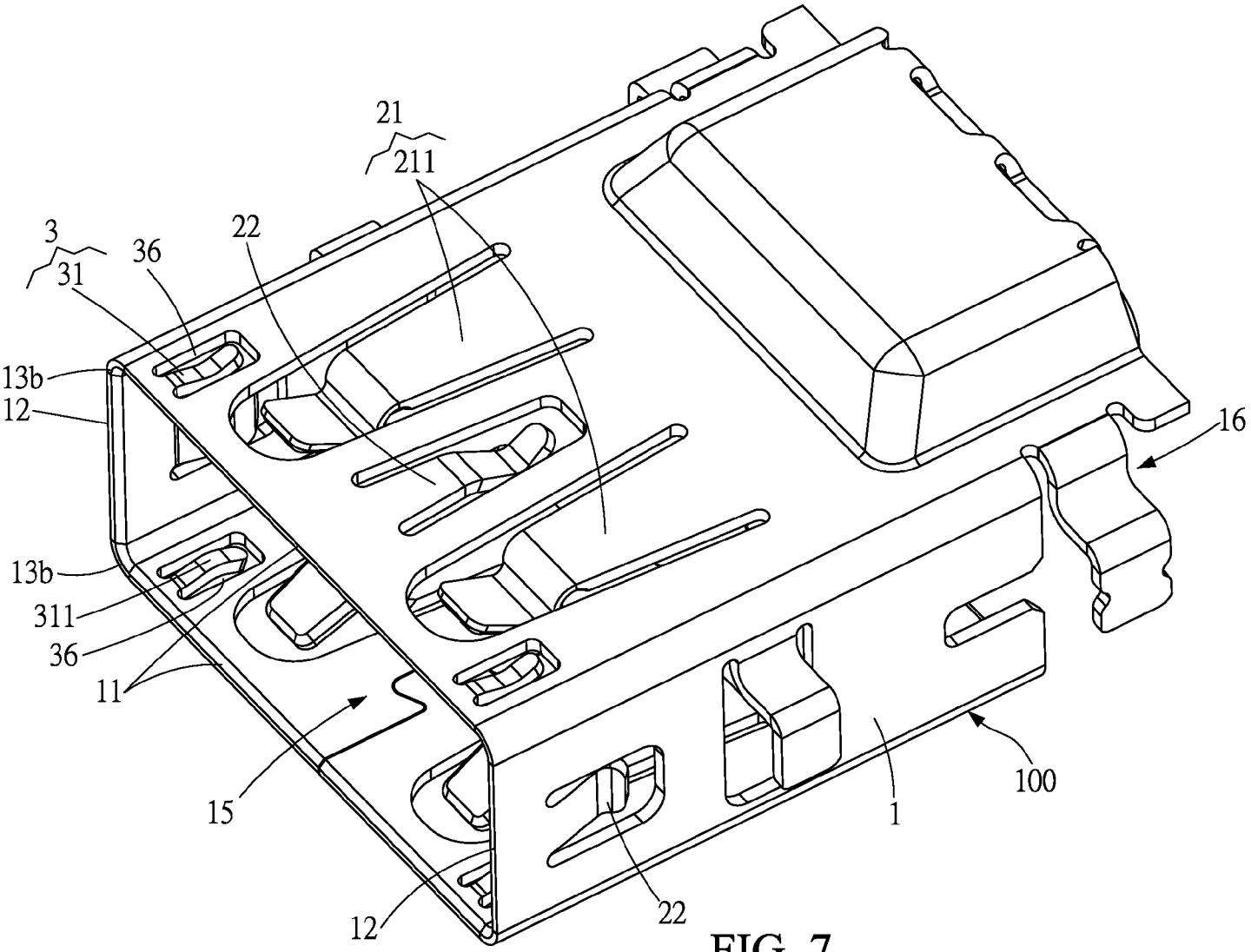
FIG. 7 is a perspective view of the auxiliary fastening member of the receptacle connector formed in a fourth exemplary embodiment according to the present invention.

In the embodiment mentioned above, the elongating openings 35 are formed between the auxiliary fastening members 3 and the first surface 11 by a tearing process, but embodiments of the disclosure are not limited thereto. In some implementation aspects, each auxiliary fastening member 3 has a breach 36 formed on the first surface 11 and disposed between the contacting portion 31 and the first surface 11, as shown in FIG. 7. The breach 36 is manufactured by blanking process.

Referring to FIGS. 2-4, the contacting portions 31 substantially have connecting lines 311. When the contacting portions 31 are in contact with the metal shell 92 of the plug connector 91, the contacting portions 31 are connected with the surface of the metal shell 92 by the connecting lines 311 respectively. In this embodiment, a plurality of depths are defined between the connecting lines 311 and the first surfaces 11. Additionally, a distance between the connecting line 311 of the contacting portion 31 disposed on the upper surface and the connecting line 311 of the contacting portion 31 disposed on the bottom surface is smaller or equal to the height of the metal shell 92 of the plug connector 91 so as to keep the connecting lines 311 to contact with the metal shell 92.

Figure 8:
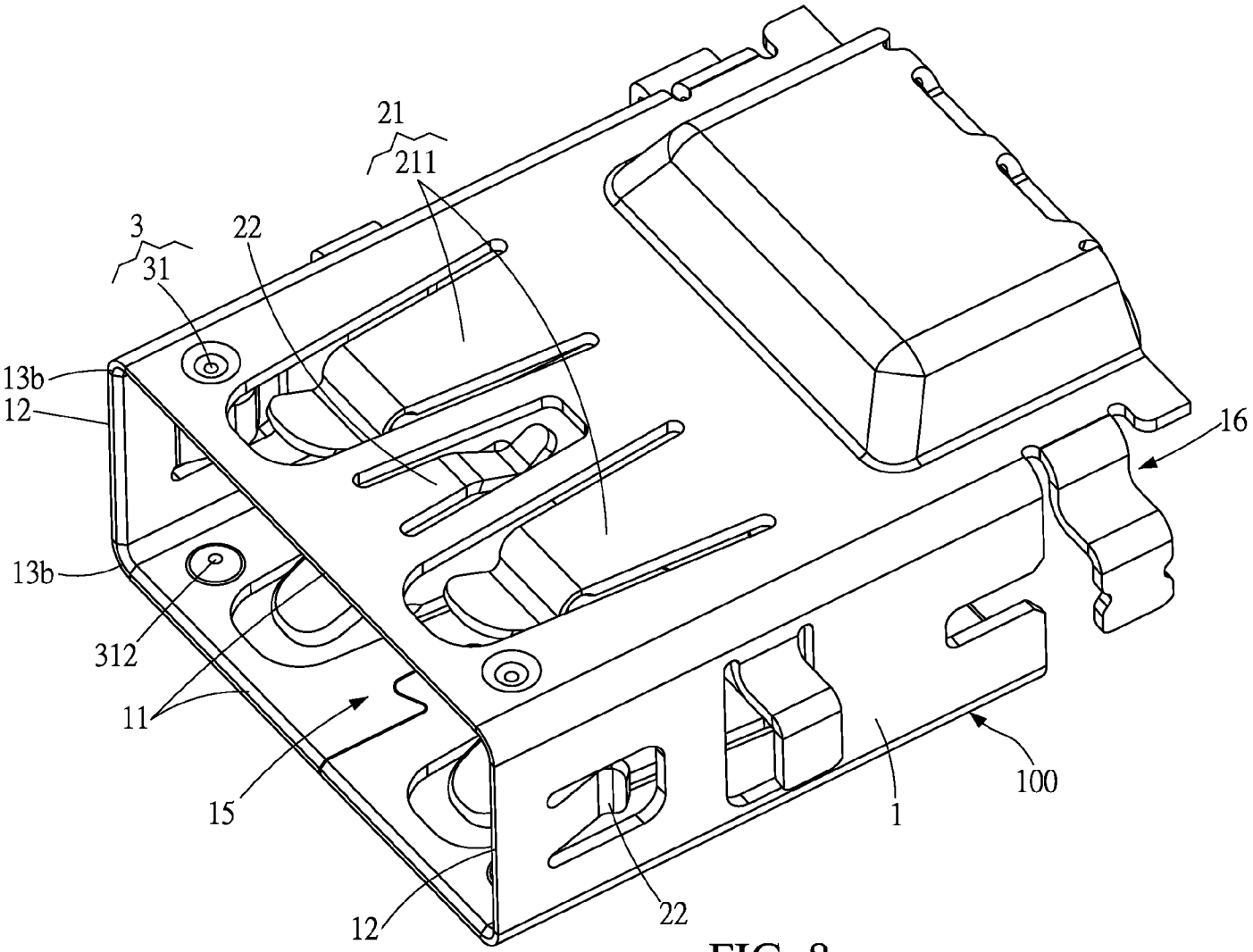
FIG. 8 is a perspective view of the auxiliary fastening member of the receptacle connector formed in a fifth exemplary embodiment according to the present invention.

In the embodiment mentioned above, the contacting portions 31 substantially have connecting lines 311 and the contacting portions 31 are in contact with the surface of the metal shell 92 by the connecting lines 311 respectively, but embodiments of the disclosure are not limited thereto. In some implementation aspects, the contacting portions 31 have connecting points 312, as shown in FIG. 8, and the contacting portions 31 are in contact with the surface of the metal shell 92 by the connecting points 312 which are protruded points formed on the contacting portions 31. In addition, in some implementation aspects, the contacting portions 31 have connecting planes 313, as shown in FIGS. 5-6, and the contacting portions 31 are in contact with the surface of the metal shell 92 by the connecting planes 313 so as to increase the contact area between the plug acceptor 91 and the receptacle connector 100 and to reduce the contact impedance or electrical resistance between the metal shell of the plug acceptor 91 and the metal shell of the receptacle connector 100.

Table 1 is a testing data sheet for comparing the contact impedance or electrical resistance between the metal shell of the plug connector 91 and the metal shell of the receptacle connector 100 with the auxiliary fastening members 3 and the contact impedance or electrical resistance between the metal shell of the plug connector 91 and the metal shell of the receptacle connector 100 without the auxiliary fastening members 3. As shown in Table 1, the contact impedance or electrical resistance between the metal shell of the plug connector 91 and the metal shell of the receptacle connector 100 without the auxiliary fastening members 3 is larger than the contact impedance or electrical resistance between the metal shell of the plug connector 91 and the metal shell of the receptacle connector 100 with four auxiliary fastening members 3. Consequently, the four auxiliary fastening members 3 are capable of reducing the contact impedance or electrical resistance between the metal shell of the plug connector 91 and the metal shell of the receptacle connector 100.

TABLE 1

| Contact resistance (Low level contact resistance, LLCR) | Unit: micro-ohm (Ω) |
|---|---|
| Without the auxiliary fastening members | 10.2 |
| With the auxiliary fastening members | 8.85 |

Figure 9:
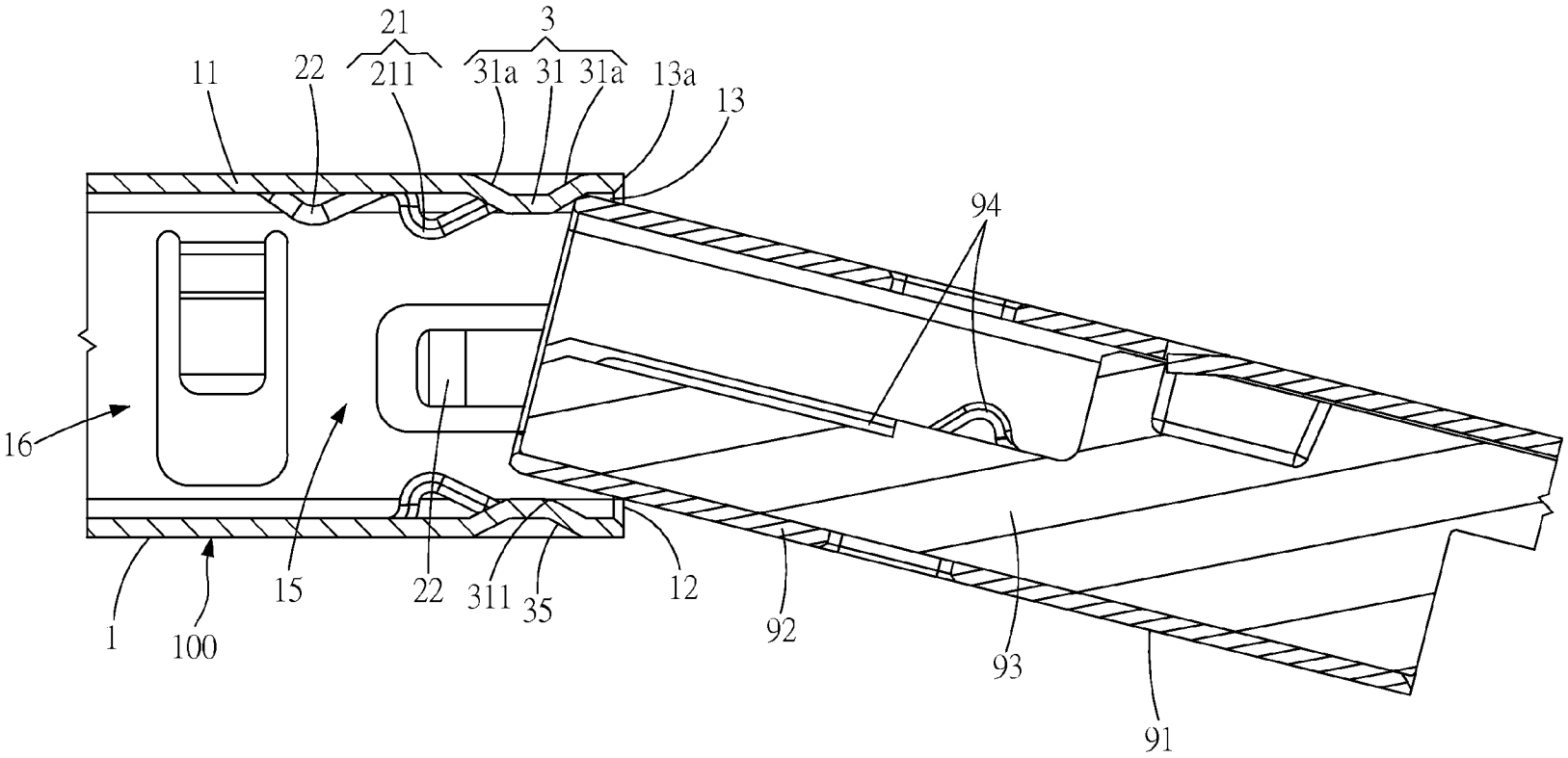
FIG. 9 is a lateral cross-sectional view showing a plug connector being inserted into the receptacle connector during insertion.

Referring to FIGS. 9-10, when the plug connector 91 is inserted into the metal shell 1 of the receptacle connector 100, the plug connector 91 is inserted into the metal shell 1 of the receptacle connector 100 through the inserting window 13. Furthermore, when the contacting portions 31 of the auxiliary fastening members 3 are in contact with the surface of the metal shell 92 of the plug connector 91, the contact area between the metal shell 92 of the plug connector 91 and the auxiliary fastening members 3 of the receptacle connector 100 can be increased by the contacting portions 31 so as to reduce the contact impedance or electrical resistance between the metal shell 92 of the plug connector 91 and the metal shell 1 of the receptacle connector 100. In addition, on the testing of the electromagnetic interference (EMI), the reducing of the contact impedance or electrical resistance causes the reducing of the electromagnetic interference.

Referring to FIGS. 9-10, when the plug connector 91 is inserted into the receptacle connector 100, the plug connector 91 is guided by the contacting portions 31 of the auxiliary fastening members 3, so that the plug connector 91 is inserted into the receptacle connector 100 stably and smoothly. Based on this, the contacting portions 31 of the auxiliary fastening members 3 prevent the elastic pieces 21 of the receptacle connector 100 from being damaged when the plug connector 91 is abnormally inserted into the receptacle connector 100. Therefore, the receptacle connector 100 of the disclosure has better sustainability and stability upon inserting into/pulling out the plug connector 91.

In the disclosure, the auxiliary fastening members 3 are disposed on the four corners of the first surfaces and near the inserting window 13 of the metal shell 1, and the contacting portions 31 of auxiliary fastening members 3 are applied to connect with the surface of the metal shell 92 of the plug connector 91 so as to increase the contact area, reduce the contact impedance or electrical resistance and further decrease the electromagnetic interference of the receptacle connector 100. In addition, the auxiliary fastening members 3 are provided for guiding the inserting orientation of the plug connector 91 so as to prevent the elastic pieces 21 of the receptacle connector 100 from being damaged when the plug connector 91 is abnormally inserted into the receptacle connector 100, so that the sustainability and the stability of the receptacle connector 100 upon inserting into/pulling out the plug connector 91 are guaranteed.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A receptacle connector for being-in contact with a metal shell of a plug connector when the plug connector is inserted into the receptacle connector, comprising:

a metal shell comprising:

a plurality of first surfaces including an upper surface and a bottom surface; and a plurality of second surfaces including a right surface and a left surface, which are connected to two ends of the first surfaces so as to form an inserting window;

a plurality of elastic pieces disposed on the first surfaces; and a plurality of auxiliary fastening members disposed on at least two corners of the first surfaces and near the inserting window, each of the auxiliary fastening members includes a contacting portion formed by extruding an inner face of the first surface toward an inner space of the metal shell of the receptacle connector, and the two ends of the contacting portion connected to the first surface;

wherein when the contacting portions are in contact with the metal shell of the plug connector, the contact area between the metal shell of the plug connector and the auxiliary fastening members are increased by the contacting portions so as to reduce the electrical impedance between the metal shell of the plug connector and the metal shell of the receptacle connector.

2. The receptacle connector according to claim 1, wherein each of the auxiliary fastening members defines an elongating opening disposed between the contacting portion and the first surface.

3. The receptacle connector according to claim 1, wherein each contacting portion comprises a connecting point, each contacting portion is contacted with the metal shell of the receptacle connector by the connecting point.

4. The receptacle connector according to claim 1, wherein each contacting portion comprises a connecting line, each contacting portion is contacted with the metal shell of the receptacle connector by the connecting line.

5. The receptacle connector according to claim 1, wherein each contacting portion comprises a connecting plane, each contacting portion is contacted with the metal shell of the receptacle connector by the connecting plane.

6. The receptacle connector according to claim 1, wherein the contact areas between the metal shell of the plug connector and the auxiliary fastening members are increased by the contacting portions so as to reduce the contact impedance between the metal shell of the plug connector and the metal shell of the receptacle connector when the contacting portions are in contact with the metal shell of the plug connector.

7. The receptacle connector according to claim 1, further comprises:

an insulated housing comprising a base portion and a tongue portion protruding beyond the base portion, wherein the tongue portion is extended along a rear-to-front direction and includes a mating face and an opposite face thereof;

a plurality of terminals held in the insulated housing and divided into a first set of terminals and a second set of terminals, wherein a plurality of elastic contact portions of the first set of terminals are located on the mating face in a first position along the rear-to-front direction and a plurality of non-elastic contact portions of the second set of terminals are located on the mating face in a second position along the rear-to-front direction which are different from the first position.

8. The receptacle connector according to claim 1, wherein each auxiliary fastening member is disposed between the near elastic piece and the near second surface.

9. The receptacle connector according to claim 1, wherein a first interval is defined between the auxiliary fastening member and the near second surface and a second interval is defined between the auxiliary fastening members.

10. A receptacle connector provided for being inserted by a plug connector and contacted with a casing of the plug connector, comprising:

a metal shell comprising:

a plurality of first surfaces; and a plurality of second surfaces, connected to two ends of the first surfaces so as to form an inserting window;

a plurality of elastic pieces, disposed on the first surfaces; and a plurality of auxiliary fastening members disposed on two sides of the first surfaces, each auxiliary fastening member comprising a contacting portion extendedly formed at an inner side of the inserting window;

wherein when the contacting portions are connected with the casing, the contact area between the casing and the auxiliary fastening members can be increased by the contacting portions so as to reduce the electrical resistance between the plug connector and the receptacle connector, and wherein the contacting portion comprises a bending segment and an extending segment, the bending segment is disposed on flange of the inserting window, the extending segment is connected to the bending segments and extended toward the inner side of the inserting window.

11. The receptacle connector according to claim 10, further comprises:

an insulated housing comprising a base portion and a tongue portion protruding beyond the base portion, wherein the tongue portion is extended along a rear-to-front direction and includes a mating face and an opposite face thereof;

a plurality of terminals held in the insulated housing and divided into a first set of terminals and a second set of terminals, wherein a plurality of elastic contact portions of the first set of terminals are located on the mating face in a first position along the rear-to-front direction and a plurality of non-elastic contact portions of second set of terminals are located on the mating face in a second position along the rear-to-front direction which are different from the first position.

12. A receptacle connector for being in contact with a metal shell of a plug connector when the plug connector is inserted into the receptacle connector, comprising:

an insulated housing comprising a base portion and a tongue portion protruding beyond the base portion, wherein the tongue portion is extended along a rear-to-front direction and includes a mating face and an opposite face thereof;

a plurality of terminals held in the insulated housing and divided into a first set of terminals and a second set of terminals, wherein a plurality of elastic contact portions of the first set of terminals are located on the mating face in a first position along the rear-to-front direction and a plurality of non-elastic contact portions of the second set of terminals are located on the mating face in a second position along the rear-to-front direction which are different from the first position;

a metal shell, comprising:

a plurality of first surfaces comprising an upper surface and a bottom surface; and a plurality of second surfaces comprising a right surface and a left surface which are connected to two ends of the upper surface and the bottom surface so as to form an inserting window;

a plurality of elastic pieces disposed on the first surfaces; and a plurality of auxiliary fastening members disposed on at least two corners of the first surfaces and near the inserting window, wherein each of the auxiliary fastening members is disposed between the near first surface and the near elastic pieces and each of the auxiliary fastening members comprises a contacting portion formed toward an inner space of the metal shell of the receptacle connector.

13. The receptacle connector according to claim 12, wherein the contacting portions are formed by extruding the inner faces of the first surfaces toward the inner space of the metal shell of the receptacle connector, and two ends of the contacting portion connected to the first surface.

14. The receptacle connector according to claim 12, wherein the contacting portions are formed by stamping the first surfaces of the metal shell of the receptacle connector and extruding the inner faces of the first surfaces toward the inner space of the metal shell of the receptacle connector.

15. The receptacle connector according to claim 12, wherein each auxiliary fastening member further defines two elongating openings which are formed between the contacting portion of each auxiliary fastening member and the first surface.

16. The receptacle connector according to claim 12, wherein a first interval is defined between the auxiliary fastening member and the near second surface and a second interval is defined between the auxiliary fastening members.

* * * * *